US005467632A

United States Patent [19]

Kogure et al.

[11] Patent Number: 5,467,632

[45] Date of Patent: Nov. 21, 1995

[54] METHOD FOR FABRICATING A CONTACT ASSEMBLY OF A MAGNETIC SWITCH

[75] Inventors: Mitsuhiro Kogure, Gumma; Shinichi Nagashima, Tochigi; Kazuhisa Wakabayashi, Gumma; Shigeyuki Enkaku, Gumma; Hitoshi Shimayama, Gumma; Minoru Kimura, Gumma; Shuji Shimoyama, Gumma; Tsugio Yokoo, Gumma, all of Japan

[73] Assignee: Mitsuba Electric Mfg. Co., Ltd., Gumma, Japan

[21] Appl. No.: 167,954

[22] PCT Filed: Apr. 30, 1993

[86] PCT No.: PCT/JP93/00588

§ 371 Date: Dec. 16, 1993

§ 102(e) Date: Dec. 16, 1993

[87] PCT Pub. No.: WO93/22783

PCT Pub. Date: Nov. 11, 1993

[30] Foreign Application Priority Data

May 6, 1992 [JP] Japan ..... 4-142099

[51] Int. Cl.[6] ..... H01R 43/16

[52] U.S. Cl. ..... 72/379.2; 29/882; 83/50; 83/861

[58] Field of Search ..... 29/622, 825, 874, 29/882; 439/485; 83/861, 50; 72/379.2

[56] References Cited

U.S. PATENT DOCUMENTS

| | | | |
|---|---|---|---|
| 3,033,959 | 5/1962 | Flanagan | 29/825 X |
| 3,509,620 | 5/1970 | Phillips | 29/874 X |
| 3,670,129 | 6/1972 | Cherry et al. | 200/166 C |
| 3,950,846 | 4/1976 | Johnson | 29/882 |
| 4,376,559 | 3/1983 | Instone, Jr. | 439/108 X |

FOREIGN PATENT DOCUMENTS

| | | |
|---|---|---|
| 51-28341 | 8/1976 | Japan . |
| 53-5768 | 1/1978 | Japan . |
| 55-15707 | 1/1980 | Japan . |
| 55-154014 | 12/1980 | Japan . |
| 56-167431 | 12/1981 | Japan . |
| 58-178919 | 10/1983 | Japan . |

*Primary Examiner*—Rinaldi I. Rada

*Attorney, Agent, or Firm*—Skjerven, Morrill, MacPherson, Franklin & Friel

[57] ABSTRACT

The capability of heat dissipation from the contact surface of a magnetic switch for a starter motor is improved without increasing the fabrication cost. A punch 28 having a plurality of square projections arranged in two mutually perpendicular directions at the pitch of P is applied to the surface of a plate member 27 to form a first group of punched recesses 29*a*. The pitch P is twice the length of a side of each punched recess 29*a*. Then, the punch 28 is shifted with respect to the first group of punched recesses 29 by P/2 in both the vertical and horizontal directions before forming a second group of punched recesses 29*b*. The punched recesses 29*a* and 29*b* define projections 26 in the parts which are not occupied by these recesses generally in the pattern of a checker board. Because the projections 26 are separated from each other, and can effectively dissipate heat therefrom, the increase in the contact resistance due to heat generation can be prevented, and the efficiency of the starter motor can be increased by using a punching process which is both simple and economical.

6 Claims, 4 Drawing Sheets

METHOD FOR FABRICATING A CONTACT ASSEMBLY OF A MAGNETIC SWITCH

DESCRIPTION

1. Technical Field

The present invention relates to a contact assembly for a magnetic switch comprising a pair of fixed contact members and a plate-shaped moveable contact member adapted to be selectively connected across the fixed contact members, and a method for fabricating the same. The present invention particularly relates to a contact assembly for a magnetic switch suitable for use in a starter motor, and a method for fabricating the same.

2. Background Art

In the magnetic switch of an automotive starter motor, an plunger is driven by selectively supplying electric current to an energization coil, and the resulting movement of the plunger shifts a pinion gear into mesh with a ring gear. A plate-shaped moveable contact member is integrally secured to a rod which is moved by the movement of the plunger, and the motor is electrically connected to a battery by selectively contacting this contact member across a pair of fixed contact members.

In such a magnetic switch, when the switch is closed, a relatively large current flows through the switch, and the temperature of the contact surface tends to rise as a result of this electric current, thereby increasing the contact resistance and impairing the efficiency of the switch. Japanese utility model laid open publication No. 53-155060 discloses a contact assembly in which the contact surface is provided with a surface irregularity, and the state of contact is made stable by preventing slippage at the time of contact. By thus providing a surface irregularity in the contact surface, the effective surface area for heat dissipation is increased, and the heat is more efficiently removed from the contact surface.

To optimize the efficiency of heat dissipation, each projection in the irregular contact surface is required to be separated from other projections. However, forming such surface irregularities will require punches having highly complex configurations, and it will increase the fabrication cost.

DISCLOSURE OF THE INVENTION

In view of such problems of the prior art, a primary object of the present invention is to provide a contact assembly for a magnetic switch suitable for use in a starter motor which can improve the efficiency of heat dissipation from the contact surface without increasing the fabrication cost.

According to the present invention, such an object can be accomplished by providing a contact assembly for a magnetic switch comprising a pair of fixed contact members and a plate-shaped moveable contact member adapted to be selectively connected across the fixed contact members, characterized by that: a contact surface of at least one of the fixed contact members and the moveable contact member is provided with a certain irregularity in a checker board pattern.

According to a broad concept of the present invention, there is provided a contact assembly for a magnetic switch comprising a pair of fixed contact members and a plate-shaped moveable contact member adapted to be selectively connected across the fixed contact members, characterized by that: a contact surface of at least one of the fixed contact members and the moveable contact member is provided with a plurality of projections which are separated from each other or connected by narrowed parts.

By thus providing a surface irregularity in a checker board pattern or a plurality of projections separated from each other in at least one of the fixed and moveable contact members, each projection in the surface irregularity can be separated from other projections.

Thus, the interval between adjacent projections can be relatively large, and the necessary die or the punch can be easily fabricated. Furthermore, the pressing force required for the punching process can be made relatively small, and the fabrication cost can be reduced. In particular, when these projections are provided with polygonal forms, they can be easily fabricated by machining.

BRIEF DESCRIPTION OF THE DRAWINGS

FIG. 4(*b*) is a plan view showing the state of the contact surface after the second group of punched recesses are formed; and FIG. 4(*c*) is a plan view of a completed moveable contact member.

BEST MODE FOR CARRYING OUT THE INVENTION

Now the preferred embodiment of the present invention is described in the following with reference to the appended drawings.

Figure 1:
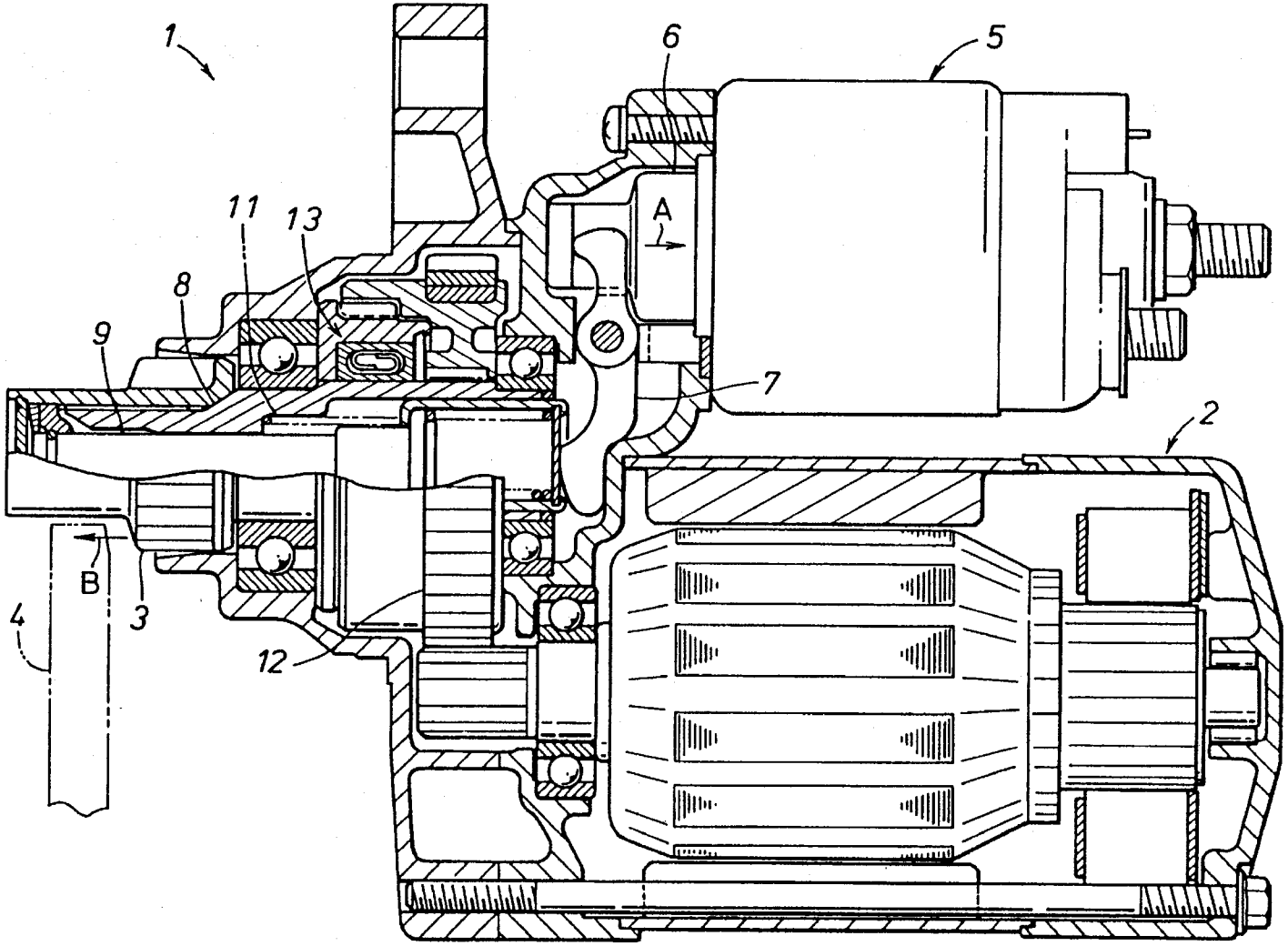
FIG. 1 is a partly broken away sectional side view of an essential part of an automotive starter motor to which the present invention is applied.

FIG. 1 is a sectional side view, taken along an axial line, of an essential part of a starter motor 1 according to the present invention mounted on an automotive engine. In this starter motor 1, a pinion gear 3 turned by an electric motor 2 is selectively meshed with a ring gear 4 of an engine not shown in the drawing for driving the ring gear 4, and the shifting movement of the pinion gear 3 and the activation of the motor 2 are accomplished by turning on and off a magnetic switch 5 integrally provided in the starter motor 1. As shown in the drawing, a shift fork 7 is interposed between an plunger 6 of the magnetic switch 5 and the pinion gear 3, and the plunger 6 and the pinion gear 3 are connected to each other via the shift fork 7 in such a manner that the pinion gear 3 may be selectively shifted in synchronism with the axial movement of the plunger 6.

The pinion gear 3 is coaxially fitted on a pinion gear support shaft 8 extending in parallel with the axial line of the motor 2, and is connected to the pinion gear support shaft 8, for instance via a spline coupling, so as to be able to transmit torque but freely moveable in the axial direction relative to the pinion gear support shaft 8. This pinion gear support shaft 8 has a hollow interior through which a push rod 9, connected to the pinion gear 3, is passed in a coaxial manner. The push rod 9 is biased by a spring force of a return spring 11 in the direction to retract the pinion gear 3. An end of the shift fork 7 abuts the rear end surface of the push rod 9, and the other end of the shift fork 7 is engaged in a groove provided in the forward end of the plunger 6.

An input gear 12 is freely rotatably fitted on the pinion gear support shaft 8, and meshes with another gear mounted on the drive shaft of the motor 2. The torque thus transmitted to the input gear 12 is in turn transmitted to the pinion gear support shaft 8 via a one-way clutch 13.

In this starter motor 1, when a coil (which is described hereinafter) of the magnetic switch 5 is energized, the plunger 6 is moved in the direction for retraction as indicated by the arrow A in the drawing, and this in turn causes the shift fork 7 to be rotated in clockwise direction in the drawing. As a result, the pinion gear 3 is pushed out against the spring force of the return spring 11 in the direction indicated by the arrow B. At the same time, the switch action of the magnetic switch 5 causes electric current to flow into the motor 2, and the drive torque of the motor 2 is transmitted to the pinion gear support shaft 8 via the input gear 12 and the one-way clutch 13, thereby rotatively driving the pinion gear support shaft 8 along with the pinion gear 3. Therefore, once the pinion gear 3 is thus thrust forward into mesh with the ring gear 4, the torque transmitted from the motor 2 can drive the ring gear.

Figure 2:
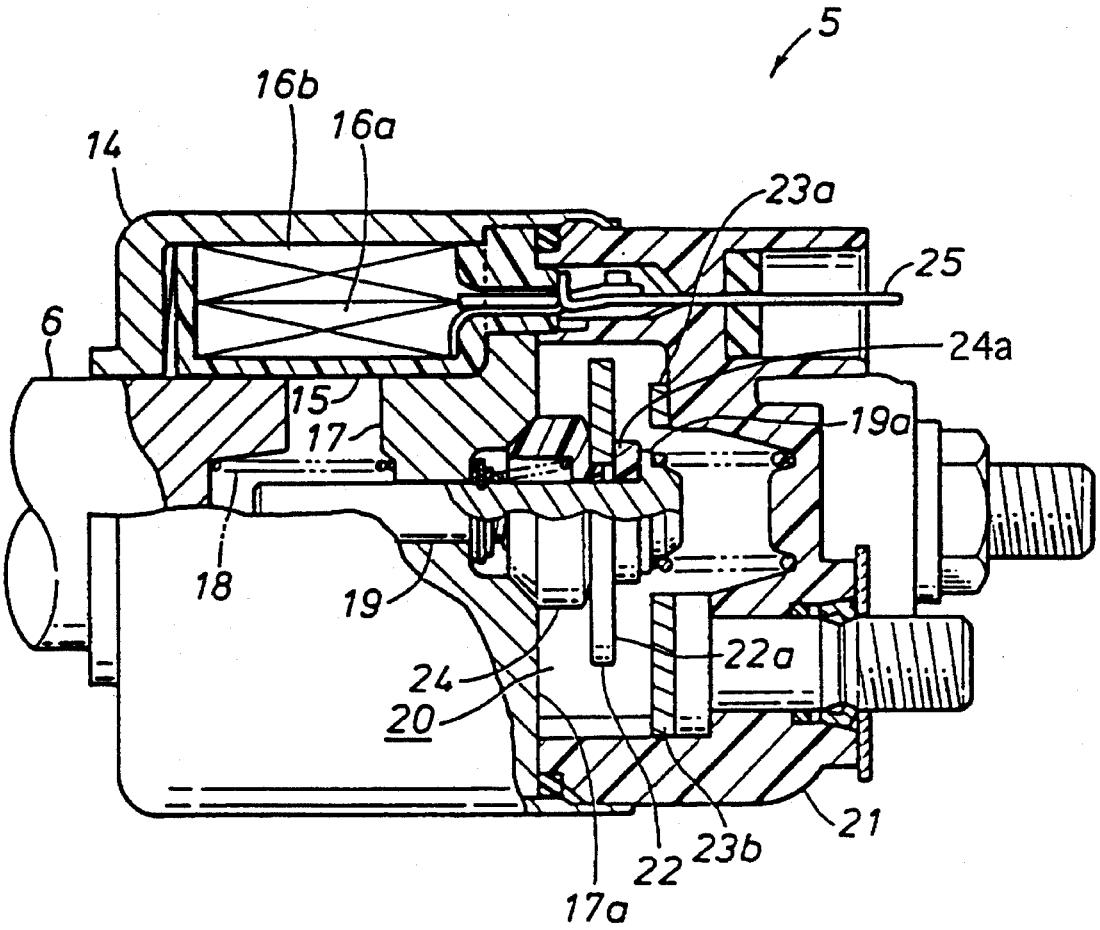
FIG. 2 is a partly broken away enlarged sectional side view of an essential part of the magnetic switch according to the present invention.

The internal structure of the magnetic switch 5 is now described in the following with reference to the sectional side view of an essential part given in FIG. 2. This magnetic switch 5 is provided with a yoke 14 consisting of magnetic material and serving also as a cup-shaped casing, and an energization coil wound around a bobbin 15 is coaxially received in the yoke 14. The energization coil consists of an pull-in coil **16*a* formed by winding a relatively thick wire around the bobbin 15 in a relatively inner part of the energization coil, and a holding coil 16*b* formed by winding a relatively thin wire around the bobbin 15** in a relatively outer part of the energization coil.

The aforementioned plunger 6 is axially slidably received in an axial through hole centrally provided in the closed bottom wall of the yoke 14, and an inner circumferential surface of the coil bobbin 15. A boss forming a part of a fixed iron core 17 is received in the central bore of the coil bobbin 15 from an end opposite from the end receiving the plunger 6. A return spring 18 is interposed between the fixed iron core 17 and the plunger 6 for returning the plunger 6 to its original position when the energization coil 16 is de-energized.

A rod 19 is axially slidably received in an axial central bore of the fixed iron core 17. One end of the rod 19 opposes the plunger 6 while the other end of the rod 19 is received in a switch chamber 20 defined between an external radial flange **17*a* of the fixed iron core 17 and a cup-shaped switch cover 21. A moveable contact member 22 is fitted on the mentioned other end of the rod 19, with a flange 19*a* provided on the rod 19 preventing the moveable contact member 22 from sliding off the rod 19. A pair of fixed contact members 23*a* and 23*b* are arranged on an inner surface of the switch cover 21 opposite to the moveable contact member 22. One of the fixed contact members 23*a* is a positive contact connected to the positive terminal of a battery not shown in the drawings, and the other fixed contact member 23*b* is a negative contact connected to a power input terminal of the motor 2**.

The moveable contact member 22 is secured to the rod 19 via an insulator 24, and the insulator 24 is elastically urged toward the fixed contact members **23*a* and 23*b* by a contact spring consisting of a conical compression coil spring. Therefore, when the rod 19 is displaced toward the fixed contact members 23*a* and 23*b*, and the moveable contact member 22 is brought into contact with the fixed contact members 23*a* and 23*b*, the state of contact is maintained by a certain elastic biasing force. A return spring consisting of a compression coil spring is interposed between the flange 19*a* of the rod 19 and the opposite surface of the switch cover 21 so that the rod 19 is initially urged toward the fixed iron core 17 illustrated in FIG. 2**.

One pair of ends of the mentioned two coils **16*a* and 16*b* are joined together, and are passed through the external radial flange of the coil bobbin 15, and are connected to a switch terminal 25 extending through the wall of the switch cover 21. The switch terminal 25 is in turn electrically connected to an ignition switch not shown in the drawing. The other end of the holding coil 16*b* is grounded via the fixed iron core 17, and the other end of the pull-in coil 16*a* is connected to the fixed contact member 23*b* associated with the terminal leading to the motor 2**.

According to this magnetic switch, by energizing both the coils **16*a* and 16*b* jointly forming the energization coil 16, the plunger 6 is attracted to the fixed iron core 17. The rod 19 is displaced as a result of the movement of the plunger 6, and the moveable contact member 22 is brought into contact with the fixed contact members 23*a* and 23*b* so as to electrically connect them together and conduct electric current to the motor 2**.

Figure 3:
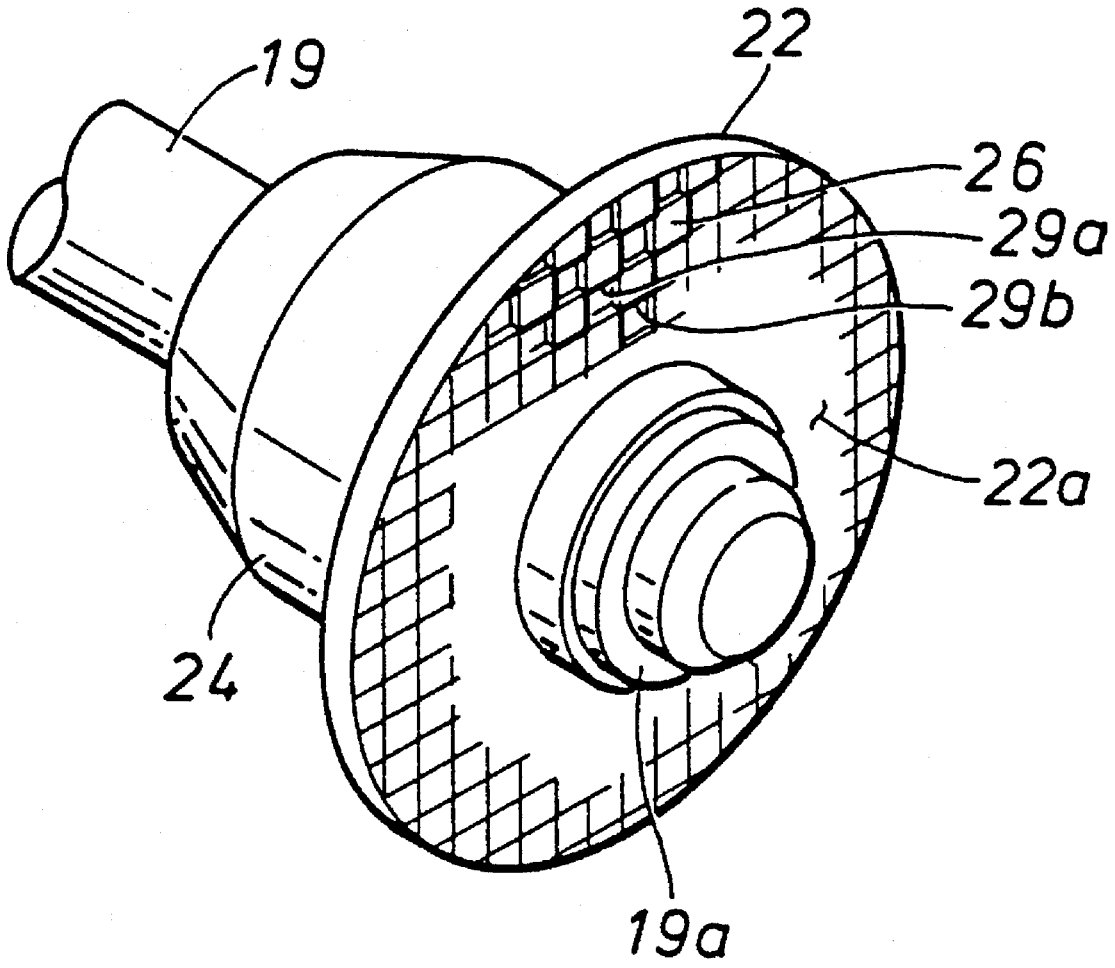
FIG. 3 is a perspective view of a moveable contact member according to the present invention.

The moveable contact member 22 of this magnetic switch 5 has a contact surface **22*a* for contact with the fixed contact members 23*a* and 23*b* which is provided with a plurality of projections 26 as illustrated in FIG. 3. Therefore, when the moveable contact member 22 is brought into contact with the fixed contact members 23*a* and 23*b*, the contact is made via these projections 26**.

The method for forming the projections is now described in the following with reference to FIGS. 4(*a*) through 4(*c*). First of all, a punch 28 having a plurality of square projections (not shown in the drawings) arranged in two mutually perpendicular directions at the pitch of P is applied to the surface of a plate member 27 made of oxygen-free copper so that a first group of punched recesses **29*a* may be formed therein in a checker board pattern. The pitch P is a multiple of (in this case, twice) the length of a side of each punched recess 29*a*. The area corresponding to the central part which is to be brought into contact with a Bakelite washer 24*a*** is not formed with any punched recesses.

Figure 4A:
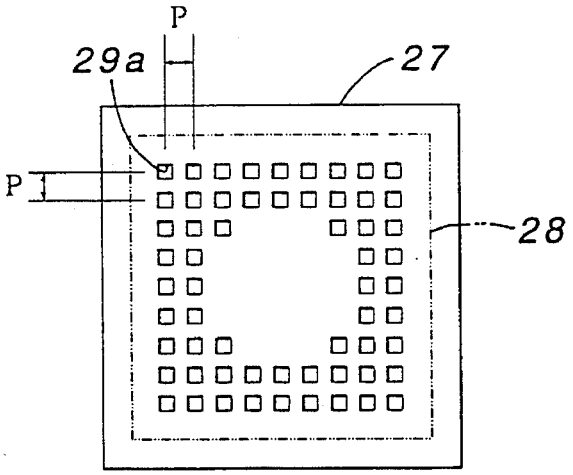
FIG. 4(*a*) is a plan view showing the state of the contact surface after the first group of punched recesses are formed.
Figure 4B:
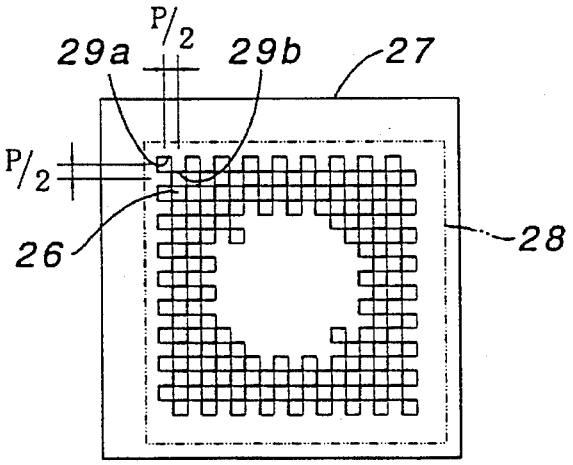
Figure 4C:
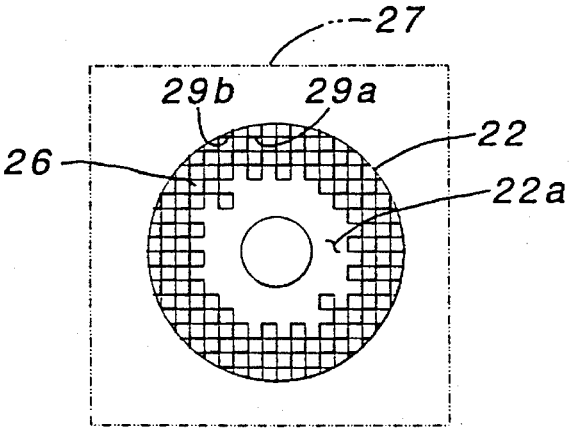

Then, the punch 28 is shifted with respect to the plate member 27 in which the first group of punched recesses 29 are formed by P/2 in both the vertical and horizontal directions, or obliquely by half the pitch, and a second group of punched recesses **29*b* are then formed as shown in FIG. 4**(*b*). As a result, the punched recesses **29*a* and 29*b* of the two groups are formed in a mutually staggered relationship, and the surface area other than that occupied by the punched recesses 29*a* and 29*b* projects relative to these punched recesses, and, in effect, a plurality of projections 26 are formed by a plurality of recesses defined by the punched recesses 29*a* and 29*b***.

Thus, the pitch of the checker board pattern is P/2 although the pitch of the projections in the punch 28 is a multiple of (twice) this pitch, or P. Therefore, the desired surface irregularity in a checkered pattern can be formed by repeating the punching step twice and shifting the punch from the first punching step to the second punching step in a simple and economical manner.

Thereafter, as shown in FIG. 4(*c*) the plate member 27 is punched out as a circular disk, and a circular central hole is also punched out so that an annular, plate-shaped moveable contact member 22 may be formed. In the moveable contact member 22 thus formed, since each side of the punched recesses 29*a* and 29*b* formed in the contact surface 22*a* and the vertical and horizontal pitch P of the checker board pattern are equal to each other, the projections 26 are arranged without any overlap between them. Therefore, the projections 26 are separated from each other, and can effectively dissipate heat generated at the time of contact between the contact members so that the increase in the contact resistance due to accumulation of heat can be minimized.

According to the present invention, the projections 26 are not necessarily required to be rectangular in shape, but may have other shapes such as triangular, parallelepiped, polygonal and other shapes. Also, the projections of the punch 28 may have circular and other shapes involving curved lines. In the latter case, the projections 26 will have shapes that are defined by circular or otherwise curved lines. The surface irregularity was provided in the moveable contact member in a checker board pattern in the above described embodiment, but it is also possible to provide a checker board irregularity pattern in the fixed contact members or in all of the contact members.

INDUSTRIAL APPLICABILITY

Thus, according to the present invention, because at least one of the contact surfaces of the moveable contact member and the fixed contact members is provided with an irregular surface in the checker board pattern, the projections are separated from each other, and dissipation of heat from these projections can be effected in a highly efficient manner. Thus, the increase in the contact resistance due to heat generation can be prevented, and the efficiency of the starter motor can be increased. The surface irregularity in the checker board pattern can be easily formed by applying a punch having a plurality of projections at a multiple of the pitch of the checker board pattern a number of times after shifting the punch each time. Thus, the increase in the fabrication cost can be avoided.

We claim:

1. A method for fabricating a contact assembly for a magnetic switch comprising a pair of fixed contact members and a plate-shaped moveable contact member adapted to be selectively connected across the fixed contact members, said method comprising:

punching a contact surface of at least one of the fixed contact members and the moveable contact member to form a first plurality of recesses which are separated from each other, said punching being by operation of a punch having a plurality of projections at a certain pitch applied to the contact surface; shifting the relative position of the punch and the contact surface a prescribed distance; and punching with the punch the contact surface at the relative shifted position to form a second plurality of recesses on the contact surface at the shifted position of the punch and contact surface.

2. A method for fabricating a contact assembly for a magnetic switch according to claim 1, wherein each of the projections on said punch is provided with a substantially square shape, and the said pitch is substantially a multiple of the length of each side of the substantially square projections.

3. A method for fabricating a contact assembly for a magnetic switch according to claim 2, wherein the punching steps include arranging the first and second plurality of recesses in a checker board pattern.

4. A method for fabricating a contact assembly for a magnetic switch according to claim 1, further comprising the step of punching out the contact member into a prescribed shape after completion of the punching steps.

5. A method for fabricating a contact assembly for a magnetic switch according to claim 4 wherein said punching out step comprising punching out the contact member as a circular disk and punching out a circular central hole in the contact member.

6. A method for fabricating a contact assembly for a magnetic switch according to claim 1 further comprising forming said pluralities of recesses in a mutually staggered relationship with a plurality of contact surface projections being formed between said first and second pluralities of recesses.

* * * * *